US009428929B2

(12) United States Patent
Prendergast et al.

(10) Patent No.: US 9,428,929 B2
(45) Date of Patent: Aug. 30, 2016

(54) AUTOMATIC SKIMMER CLEANING SYSTEM

(76) Inventors: William Scott Prendergast, Leesburg, VA (US); Daniel Max Morgan, Falls Church, VA (US)

( * ) Notice: Subject to any disclaimer, the term of this patent is extended or adjusted under 35 U.S.C. 154(b) by 816 days.

(21) Appl. No.: 13/244,175

(22) Filed: Sep. 23, 2011

(65) Prior Publication Data

US 2012/0248045 A1 Oct. 4, 2012

Related U.S. Application Data

(60) Provisional application No. 61/385,755, filed on Sep. 23, 2010.

(51) Int. Cl.
*E04H 4/12* (2006.01)

(52) U.S. Cl.
CPC ..... *E04H 4/1272* (2013.01)

(58) Field of Classification Search
CPC ..... E04H 4/1272
USPC ..... 210/94, 167.1, 167.12, 232, 416.1, 210/416.2, 448
See application file for complete search history.

(56) References Cited

U.S. PATENT DOCUMENTS 3,442,385 A 5/1969 Nash
3,443,264 A 5/1969 Miller
3,508,661 A * 4/1970 Gershman et al. ..... 210/167.12
3,513,977 A 5/1970 Bellinson
3,792,499 A * 2/1974 Whitaker ..... E04H 4/1272 210/167.1
4,154,679 A * 5/1979 Farage ..... E04H 4/1272 210/121
4,879,772 A * 11/1989 Meloney, Jr. ..... E04H 4/1272 210/167.1
6,029,290 A 2/2000 Butcher et al.
7,252,761 B2 * 8/2007 Lamberts Van Assche ..... 210/167.12
7,402,242 B2 7/2008 Duckett
7,537,691 B2 * 5/2009 Reid ..... 210/167.12
2004/0182766 A1 * 9/2004 Kelty ..... 210/169
2006/0138033 A1 6/2006 Hoal
2007/0163933 A1 * 7/2007 Goggin ..... 210/167.1
2008/0073257 A1 * 3/2008 Foley ..... E04H 4/1272 210/167.1
2008/0099386 A1 * 5/2008 Pellington ..... E04H 4/1272 210/167.1
2008/0308478 A1 * 12/2008 Stern et al. ..... 210/167.1
2009/0120857 A1 * 5/2009 Bair ..... E04H 4/1272 210/167.1

* cited by examiner

*Primary Examiner* — Fred Prince
(74) *Attorney, Agent, or Firm* — Symbus Law Group, LLC; Clifford D. Hyra

(57) ABSTRACT

A new automatic pool skimmer cleaning system includes an auto clean skimmer, debris basin, and pump. A check valve line runs from the side of the skimmer to the debris basin. When the pump is run, suction on the check valve line opens the valve and allows water and accumulated debris in the skimmer to flow into the debris basin, where debris is caught in a debris basket. The filtered water is returned to the skimmer. Debris accumulates in the debris basin over a season and is occasionally emptied. The system's pump operates independently of the pool's filtration system and is run when the filtration pump is cycled off. For vacuuming, a vacuum attachment connects to the check valve line and allows vacuumed water to be passed directly through the debris basin and debris basket and then returned to the filtration system, avoiding the need to backwash the filter.

22 Claims, 11 Drawing Sheets

AUTOMATIC SKIMMER CLEANING SYSTEM

This application claims the benefit of U.S. Provisional Application No. 61/385,755, filed Sep. 23, 2010, which is hereby incorporated by reference in its entirety.

BACKGROUND

The present invention relates generally to swimming pool cleaning devices and more specifically to skimmers.

Needs exist for improved swimming pool cleaning devices.

SUMMARY

It is to be understood that both the following summary and the detailed description are exemplary and explanatory and are intended to provide further explanation of the invention as claimed. Neither the summary nor the description that follows is intended to define or limit the scope of the invention to the particular features mentioned in the summary or in the description.

In certain embodiments, the disclosed embodiments may include one or more of the features described herein.

The Automatic Pool Skimmer Cleaning System (APSCS) includes a newly designed auto clean skimmer, debris basin, and pump. The APSCS has two operating modes: Vacuum and Clean Mode. In clean mode, floating debris that has accumulated in the auto clean skimmer is automatically removed to the debris basin. In vacuum mode, debris that has fallen to the bottom of the pool is suctioned with a vacuum attachment and removed to the debris basin. The APSCS greatly enhances pool owners' enjoyment, greatly reducing required maintenance and allowing the pool equipment to run longer and more efficiently as a result of the majority of cleaning functions being handled by the APSCS. The APSCS is a stand-alone system independent of the standard pool equipment.

When the pump is set to Clean Mode, it creates suction in the check valve line which opens the check valve and allows water and accumulated debris in the auto clean skimmer to flow into the debris basin. Debris and collected material are trapped in the debris basket for collection. The "clean" water is then returned to the auto clean skimmer. Debris accumulates in the debris basin over a season and is occasionally emptied. The frequency with which the debris basket is emptied is determined by the amount of material collected and the size of the debris basin, but in an exemplary embodiment and installation, a pool owner only has to empty it twice a season, compared to daily emptying of a traditional pool skimmer.

A new automatic pool skimmer cleaning system includes a skimmer, debris basin, and pump. A check valve line runs from the side of the skimmer to the debris basin. When the pump is run, suction on the check valve line opens the valve and allows water and accumulated debris in the skimmer to flow into the debris basin, where debris is caught in a debris basket. The filtered water is returned to the skimmer. Debris accumulates in the debris basin over a season and is occasionally emptied. The system's pump operates independently of the pool's filtration system and is run when the filtration is cycled off. For vacuuming, a vacuum attachment connects to the check valve line and allows vacuumed water to be passed directly through the debris basin and debris basket and then returned to the filtration system, avoiding the need to backwash the filter.

These and other objectives and features of the invention are apparent in the disclosure, which includes the above and ongoing written specification.

BRIEF DESCRIPTION OF THE DRAWINGS

The accompanying drawings, which are incorporated herein and form a part of the specification, illustrate exemplary embodiments and, together with the description, further serve to enable a person skilled in the pertinent art to make and use these embodiments and others that will be apparent to those skilled in the art.

DETAILED DESCRIPTION

Figure 1:
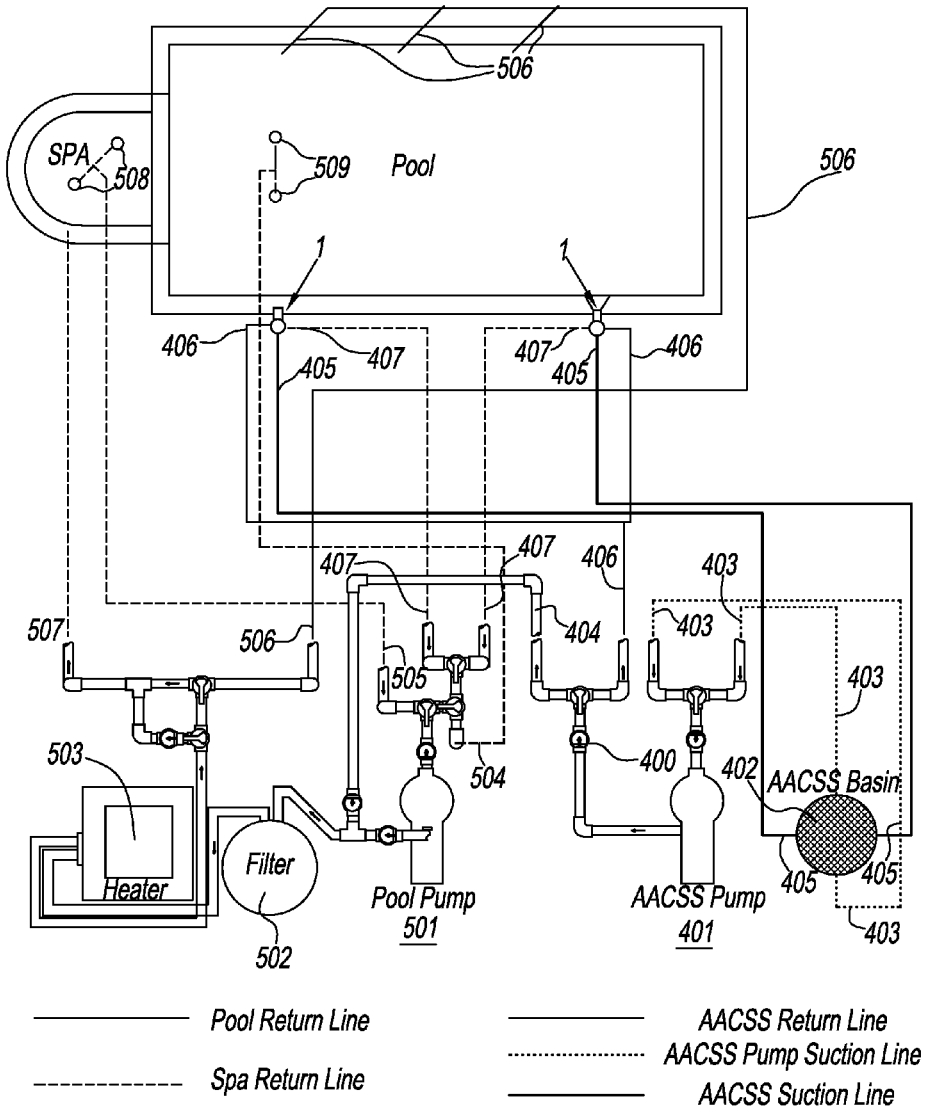
FIG. 1 is a high level diagram showing the plumbing of a pool filtration and APSCS system.

An automatic skimmer cleaning system will now be disclosed in terms of various exemplary embodiments. This specification discloses one or more embodiments that incorporate features of the invention. The embodiment(s) described, and references in the specification to "one embodiment", "an embodiment", "an example embodiment", etc., indicate that the embodiment(s) described may include a particular feature, structure, or characteristic. Such phrases are not necessarily referring to the same embodiment. When a particular feature, structure, or characteristic is described in connection with an embodiment, persons skilled in the art may effect such feature, structure, or characteristic in connection with other embodiments whether or not explicitly described.

In the several figures, like reference numerals may be used for like elements having like functions even in different drawings. The figures are not to scale. The embodiments described, and their detailed construction and elements, are merely provided to assist in a comprehensive understanding of the invention. Thus, it is apparent that the present invention can be carried out in a variety of ways, and does not require any of the specific features described herein. Also, well-known functions or constructions are not described in detail since they would obscure the invention with unnecessary detail.

A new auto cleaning skimmer system (APSCS) incorporates a newly designed auto clean pool skimmer and pipe system that is completely independent from the pool's filtration system and pump. A separate pump and pipes allow the APSCS to function even where the filtration system is not operational. APSCS eliminates the need for frequent cleaning and debris removal that is associated with existing pool skimmers. APSCS components include a new auto clean pool skimmer, debris basin and basket, pipes, winterization attachments, and a separate single phase pump.

Auto-Clean Skimmer

In some embodiments, APSCS has an inflow similar to a traditional skimmer, utilizing a weir and suction line attached to the bottom of the auto clean skimmer. The suction line runs back to the filter system and sanitizes the water through the filtration system. The APSCS can be programmed to autoclean as often as necessary. The frequency will depend on the amount of leaves or debris a pool owner encounters. Some pools have many trees overhead and thus require more frequent cleaning. When the APSCS is activated to clean, the pool's filtration system turns off and the auto clean skimmer or skimmers "autoclean", thus eliminating the need for the homeowner to manually clean the skimmer baskets of debris. Swimming pool filtration systems typically turn off each night on a daily cycle, and the APSCS can be programmed to run each night after the filtration system turns off, or each morning before it turns on.

The APSCS in some embodiments has a check valve built inside of the side of the skimmer manifold (where the pipe meets the skimmer). When in clean mode the APSCS pump is activated, which creates suction from the check valve line and opens the check valve. The check valve only allows water and debris to travel in one direction to the debris basket. The debris and water flow to the debris basket where debris is deposited. The water then re-circulates back into the pool. Manual cleaning of the debris basket should typically be performed once or twice per season, once again depending on the amount of debris that collects in the pool, as well as the size of debris basket installed with the system. This makes pool ownership much more convenient, as the typical pool owner has to clean their pool skimmer daily. The debris basket can accommodate any debris that typically enters a skimmer, including leaves, twigs, and various animals. In some embodiments, a transparent lid allows the level of the debris basket to be gauged without opening the lid.

Once the debris has entered the basin, the water is returned to the auto clean skimmer through a line at the bottom of the auto clean skimmer. This lifts off any debris that may have been caught on the strainer lid. The strainer lid prevents debris from entering the filtration system. This return line also is sized to accommodate the amount of water required to keep this system from cavitation (formation of vapor bubbles), thus preventing the cleaning pump from starving itself.

The APSCS is also advantageous for vacuuming of the pool, which is done when debris falls or sinks to the bottom of a pool. In a typical pool, vacuuming is done through the traditional skimmer line, extending the skimmer suction line to the bottom of the pool using a vacuum hose and sending collected debris to the pool filter. The filter quickly reaches its holding capacity and the person vacuuming is required to empty the filter multiple times. In some embodiments of the APSCS, the new auto clean skimmer does not use the pool's filter or filtration system, as it is completely independent. A separate clip-on device vacuum connection piece attaches to the check valve device and provides a connection for a vacuum hose, sending all vacuumed debris to the debris basket. This allows the homeowner or service technician to clean the pool much faster and more efficiently. This can also be a big advantage when winterizing a pool.

In some embodiments, at the APSCS pump there is a three way effluent valve that allows the effluent water to either return to the auto clean skimmer or enter the filter system through a series of check valves. This prevents unfiltered water from entering the pool without entering the filter media first. When vacuuming, the water is pumped through the filter by the APSCS pump before being returned to the pool, whereas for the autoclean feature the water is simply returned to the auto clean skimmer.

When vacuuming a pool, the pool pump is turned off, a vacuum connection piece is attached to the check valve line and a vacuum hose is connected to the vacuum connection piece, APSCS is manually turned on, and the three way effluent valve is set to vacuum mode. This allows the vacuumed debris to enter and be caught by the debris basket, with the water passing through the debris basket and entering the filtration system before being returned back to the pool. Once complete, the vacuum line and connection piece are removed, the APSCS pump is turned off, and the filtration system is turned back on (if desired).

Debris Basin

In some embodiments the debris basin has a series of O-rings around the top where the lid attaches, and a clear lid for the customer and/or service tech to monitor the levels of debris in the basin. In some embodiments the basin accommodates the debris from two auto clean skimmers. Two lines, in some embodiments four inch lines, are installed at the top of the basin and each is an inlet line carrying the water from an auto clean skimmer into the basin.

A debris basket in the basin has two openings where the inlet lines are attached. Debris travels through the openings and is trapped in the debris basket until it is time for service. For each auto clean skimmer feeding into the basin, there is an outlet line at the bottom of the basin and the side of the basin.

As the basin fills up with debris, the bottom outlet lines often become choked with debris. At that point, the connected suction line begins pulling from the side outlet lines that are attached on the side of the basin, in some embodiments three-fourths of the way up the side, to allow the basin to fully fill before service is required.

In some embodiments a series of clamps at the top of the basin secure the lid to create an air tight seal. This system requires all air to bleed out at the cleaning pump with an air bleeder valve. Cleaning the basin is simple. Once all the filter and cleaning pumps are turned off, the series of clamps is opened and the lid is removed. In some embodiments the debris basket has four handles with which the debris basket can be pulled out, allowing the water in the basin to be strained while bringing the debris out with the basket. At this time all debris is removed from the debris basket and disposed of.

Chlorinated water enters the basin whenever a cleaning cycle is performed (generally at least daily) so all matter in the basin will be stable and safe to work with. Once the debris basket is emptied and placed back in the basin, the lid is closed and the clamps are closed to create an air tight seal. The cleaning pump is turned on and the air in the basin is bled. Once all air has escaped the system, the cleaning pump is turned off and the filter system is turned back on. This process may be required once or twice a season, depending on how many trees and plants surround the pool, or more generally, the amount of debris that falls into the pool.

Winterization

Typically, winterization of a pool system is done through a conventional skimmer. In some embodiments, winterizing of the APSCS is performed in a similar manner. First, the filtration system is winterized in a typical fashion. Once all lines on the filtration system have been blown through and all lines are hollow, the vacuum attachment is attached to the check valve line manifold inside the auto clean skimmer. Compressed air is blown through the check valve line until the air reaches the cleaning pump. Once air reaches the pump, the basin clamps are opened and the top suction line is plugged. The system is then closed again and the bottom return line in the auto clean skimmer basin is blown through. Once compressed air has entered the cleaning pump drain plugs, the bottom line is plugged and a winterization cap is placed on the check valve line and screwed in to create a seal. When complete, antifreeze is poured in the auto clean skimmer basin and also in the debris basin. The debris basin is closed and a stone lid and/or PVC lid is placed on the auto clean skimmer.

FIG. 1 is a high level diagram showing the plumbing of a pool filtration and APSCS system. As in a standard pool filtration system, water is suctioned from the bottom of the swimming pool at drainage lines 509 and from auto clean skimmers 1 via skimmer lines 407 and spa drainage lines 508 (if present) by the pool pump 501 and sent through filter 502 and optional heater 503 before being returned to the pool and spa (if present) through return lines 506, 507. During ordinary circulation and filtration, these components function essentially as for a normal pool.

In the illustrated swimming pool system, the APSCS system including debris basin 402 and pump 401 as well as auto clean skimmers 1 (which may be original or retrofitted from original non-APSCS skimmers) has been added. Water and accumulated debris is suctioned through check valve lines 405 to APSCS debris basin 402 by APSCS pump 401. The water, filtered of debris in APSCS basin 402, exits the basin via basin outlet lines 403 and is then returned by APSCS pump 401 to the auto clean skimmers 1 via skimmer return line 406 or directly to the filter 502 via filter return line 404. Typically, the water is returned directly to the auto clean skimmers 1 after an autocleaning operation and is returned through the filtration system 502 during vacuuming of the pool. Three way effluent valve 400 governs whether the water returns to the auto clean skimmer or enters the filter system using a series of check valves. This prevents unfiltered water from entering the pool without entering the filter media first.

Figure 2:
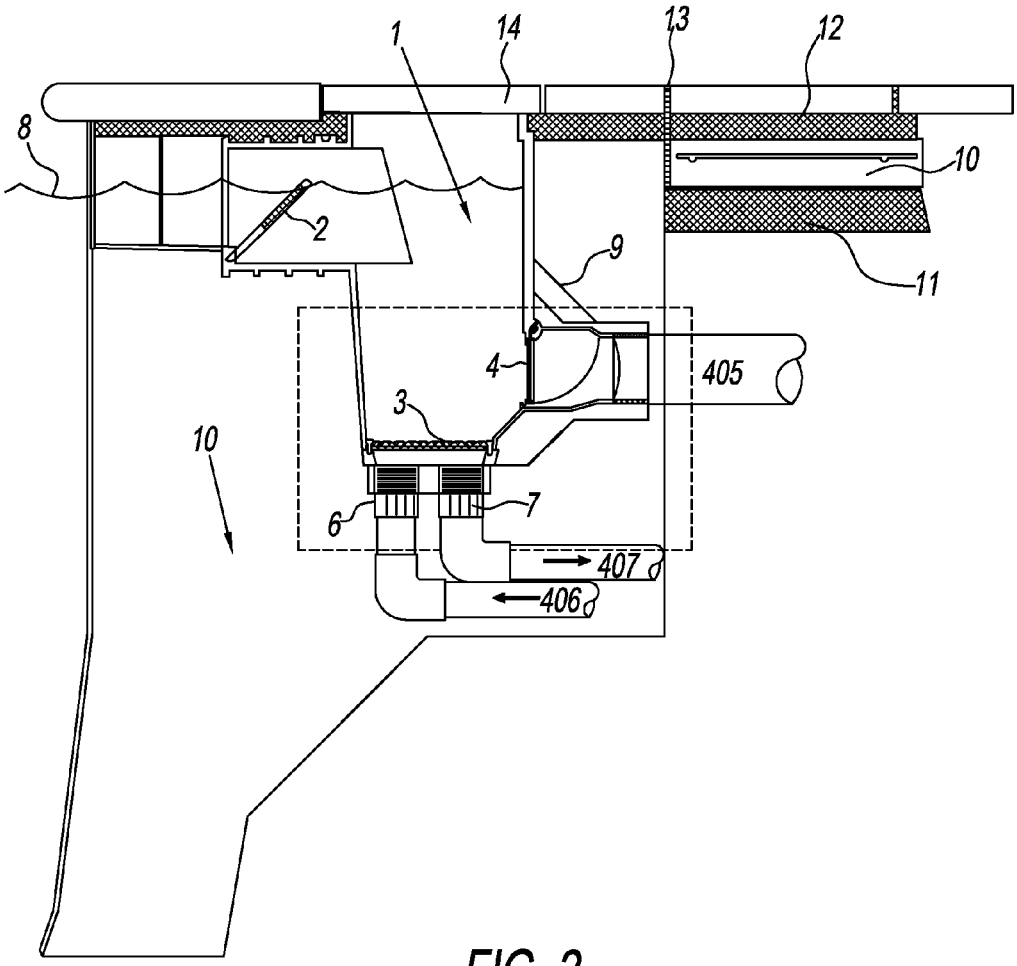
FIG. 2 is side detail diagram of an auto clean skimmer.

FIG. 2 is side detail diagram of an auto clean skimmer 1. Water 8 enters the auto clean skimmer over weir 2, allowing floating debris to enter. The pool pump (not shown) pulls water from the bottom of the auto clean skimmer through auto clean skimmer outlet 7 to the filtration system via skimmer line 407, after passing through removable strainer lid 3, which prevents large debris from entering the filtration system.

Check valve line 405 connects to the side of the auto clean skimmer, where check valve 4 controls flow from the auto clean skimmer 1 into the check valve line 405. When suction is applied by the APSCS pump (not shown) to the check valve line 405, the check valve 4 opens and allows water and accumulated debris to pass from the auto clean skimmer 1 to the debris basin (see FIG. 3) through check valve line 405.

Reinforcement brace 9 supports the check valve line to avoid cracking if pressure is applied to the check valve line. Skimmer lid 14 is in some embodiments made of stone or plastic, depending on the construction of the pool. In this diagram, pool decking construction details 10,11,12,13 are also shown. The type of decking installation used is immaterial to the functioning of the APSCS, however these details help to show the location and arrangement of the APSCS in the illustrated embodiment.

Concrete slab 10 houses rebar for structural strength. Its thickness depends on field conditions. Gravel base 11 is in some embodiments, with decking resting on virgin soil, composed of between four and six inches of #57 gravel or 21A gravel. Mortar bed 12 is composed of sand and Portland cement and locks a stone finish to the structural concrete for longevity and proper installation. Foam expansion joint 13 allows the concrete structure and pool structure to move during harsh weather with expansion and contraction. Installing a foam base and a silicone finish allows both structures to move without causing damage to the pool and/or finishing stone. Not installing an expansion joint may cause the stone on the deck to crack and/or may cause the pool coping to pop loose and damage to the pool structure may occur.

Figure 3:
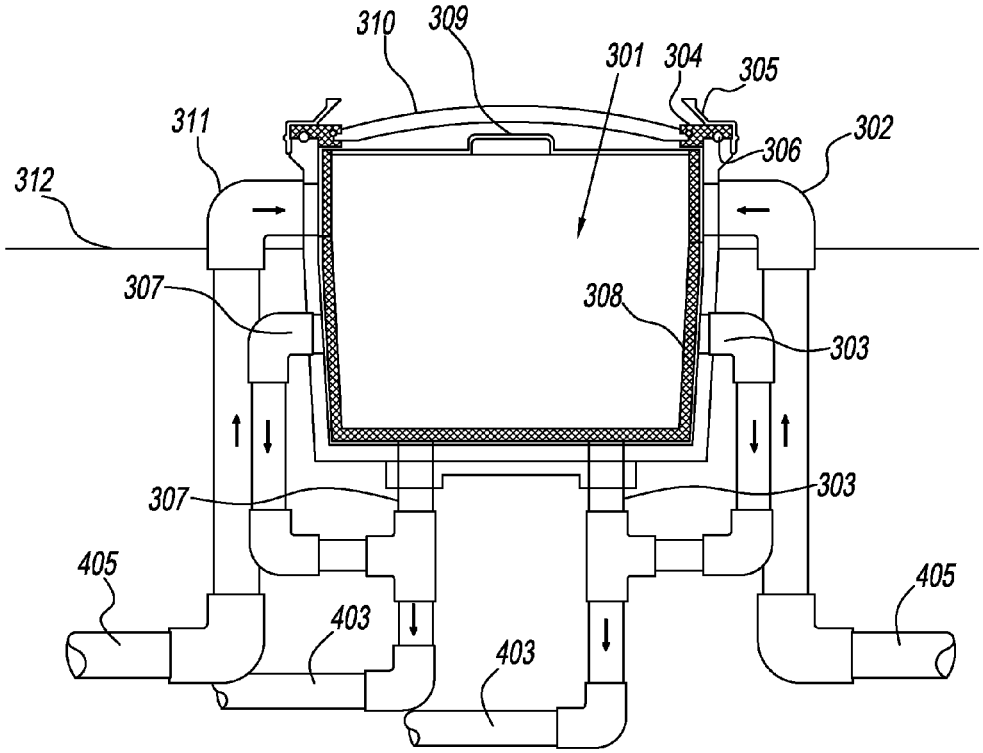
FIG. 3 is a side detail diagram of an APSCS debris basin.

FIG. 3 is a side detail diagram of an APSCS debris basin 301. In the illustrated embodiment, the debris basin 301 is connected to two auto clean skimmers as shown in FIG. 2. Water and accumulated debris enters the debris basin 301 through check valve lines 302, 311 via check valve lines 405 and openings in debris basket 308 and is suctioned by the APSCS pump (not shown) through suction lines 303, 307 to basin outlet lines 403, passing through debris basket 308 where accumulated debris is trapped. Handles 309 in the debris basket 308 allow the debris basket 308 to be periodically removed from the debris basin 301 and emptied. O-ring gaskets 306 and locking clamps 305 create an air tight seal between the lid 310 and the rest of FIG. 3 is a side detail diagram of an APSCS debris basin 301. In the illustrated embodiment, the debris basin 301 is connected to two auto clean skimmers as shown in FIG. 2. Water and accumulated debris enters the debris basin 301 through check valve lines 302, 311 via check valve lines 405 and openings in debris basket 308 and is suctioned by the APSCS pump (not shown) through suction lines 303, 307 to basin outlet lines 403, passing through debris basket 308 where accumulated debris is trapped. Handles 309 in the debris basket 308 allow the debris basket 308 to be periodically removed from the debris basin 301 and emptied. O-ring gaskets 306 and a series of locking clamps 305 create an air tight seal between the lid 310 and the rest of the basin 301. An air bleeder valve 304 permits air to bleed out. The lid 310 is clear plastic for viewing the level of accumulated debris. The debris basin 301 and piping in this embodiment are installed primarily underground, as indicated by ground surface level 312, for aesthetic reasons as well as ease of viewing and manipulation. In other embodiments, the basin system can be installed above-ground and optionally within a housing.

Figure 4:
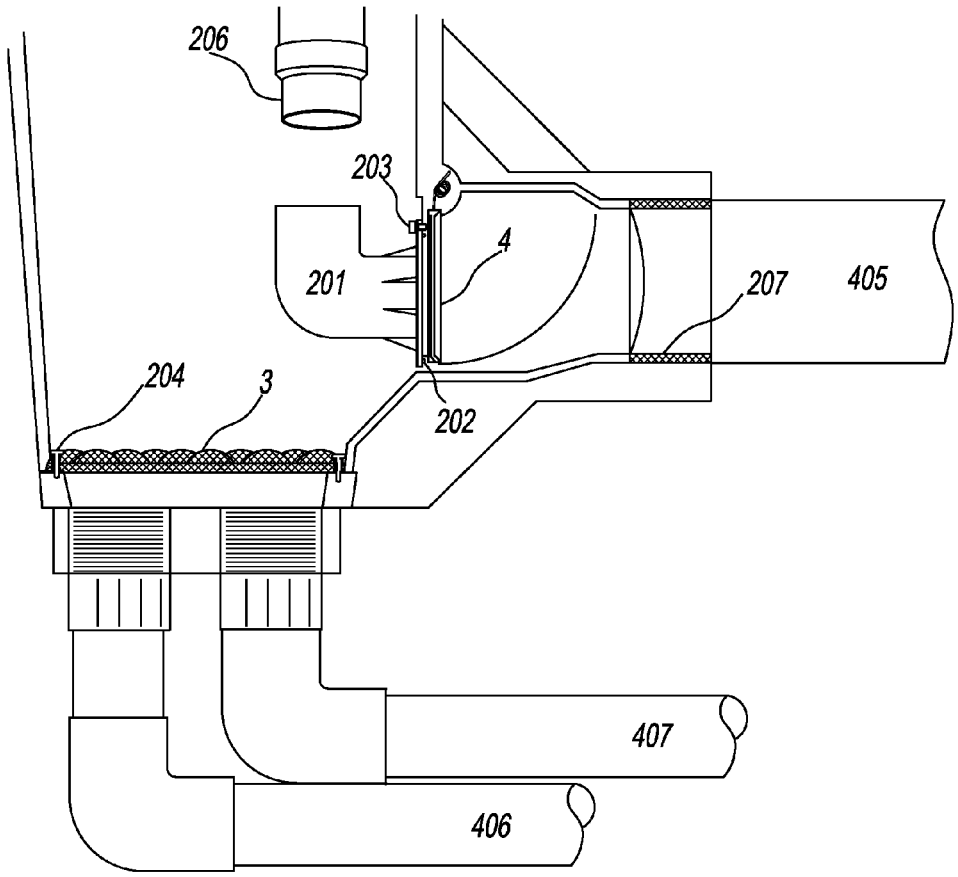
FIG. 4 is a side detail diagram of an auto clean skimmer with vacuum plate and vacuum.

FIG. 4 is a side detail diagram of an auto clean skimmer with vacuum plate and vacuum. Winterizing/vacuuming plate with gasket 201 is attached to check valve 4 with screws 203. Vacuum attachment 206 is connected to the winterizing/vacuuming plate 201 and sends the water suctioned from the bottom of the pool to the check valve line 405. The APSCS pump (not shown) suctions the check valve line 405, opening check valve 4 and allowing the vacuumed water to flow through the check valve line 405 to the APSCS debris basin (see FIG. 3). Removable strainer lid 3 remains attached over the auto clean skimmer inlet and outlet lines 407, 406 with screws 204. O-rings 202 seal the connection between the check valve 4 and winterizing/vacuuming plate 201. Slip fitting 207 attaches the check valve line 405 to the auto clean skimmer.

Figure 5:
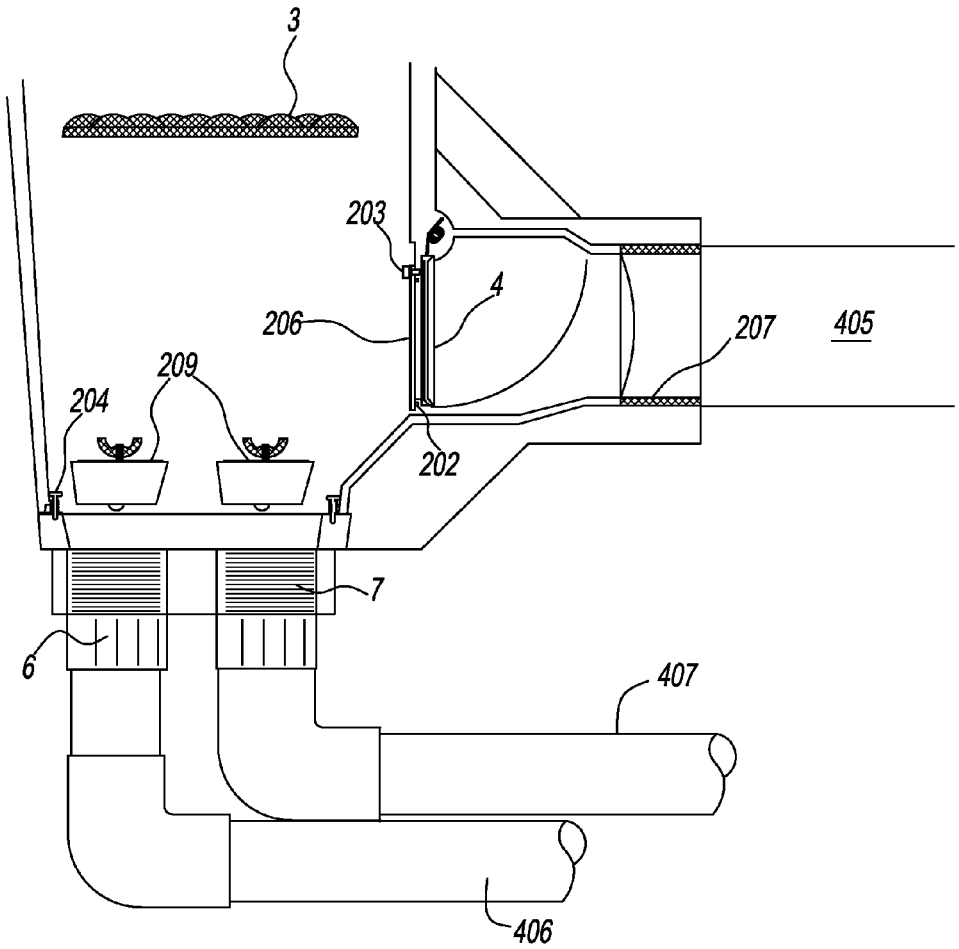
FIG. 5 is a side detail of an APSCS skimmer after winterization.

FIG. 5 is a side detail of an auto clean skimmer after winterization. Removable winterized plate with gasket 206 is inserted over check valve 4 with screw 203, preventing water from leaking into check valve line 405 from the auto clean skimmer. Removable strainer lid 3 and its screws 204 are removed and plugs 209 are inserted in the auto clean skimmer inlet and outlet lines 406, 407 to prevent water from entering the filtration system from the auto clean skimmer. Threaded adapters 6,7 connect inlet and outlet lines 406, 407 to the body of the skimmer 1.

Figure 6:
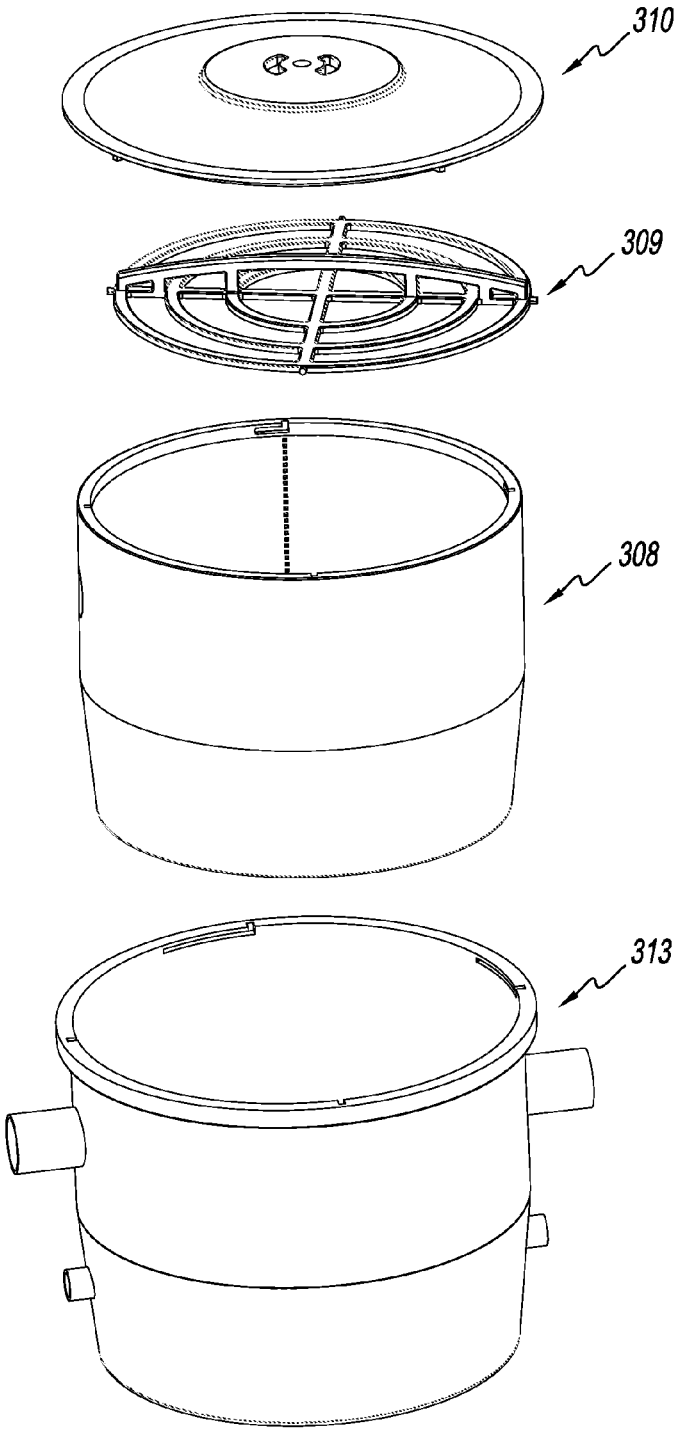
FIG. 6 is an exploded perspective view showing an arrangement of parts in a debris basin assembly.

FIG. 6 is an exploded perspective view showing an arrangement of parts in a debris basin assembly. Basin 313 is topped by transparent basin lid 310. Debris basket 308 is placed inside the basin 313 to filter large debris from water delivered into the basin, and has its own lid 309.

Figure 7:
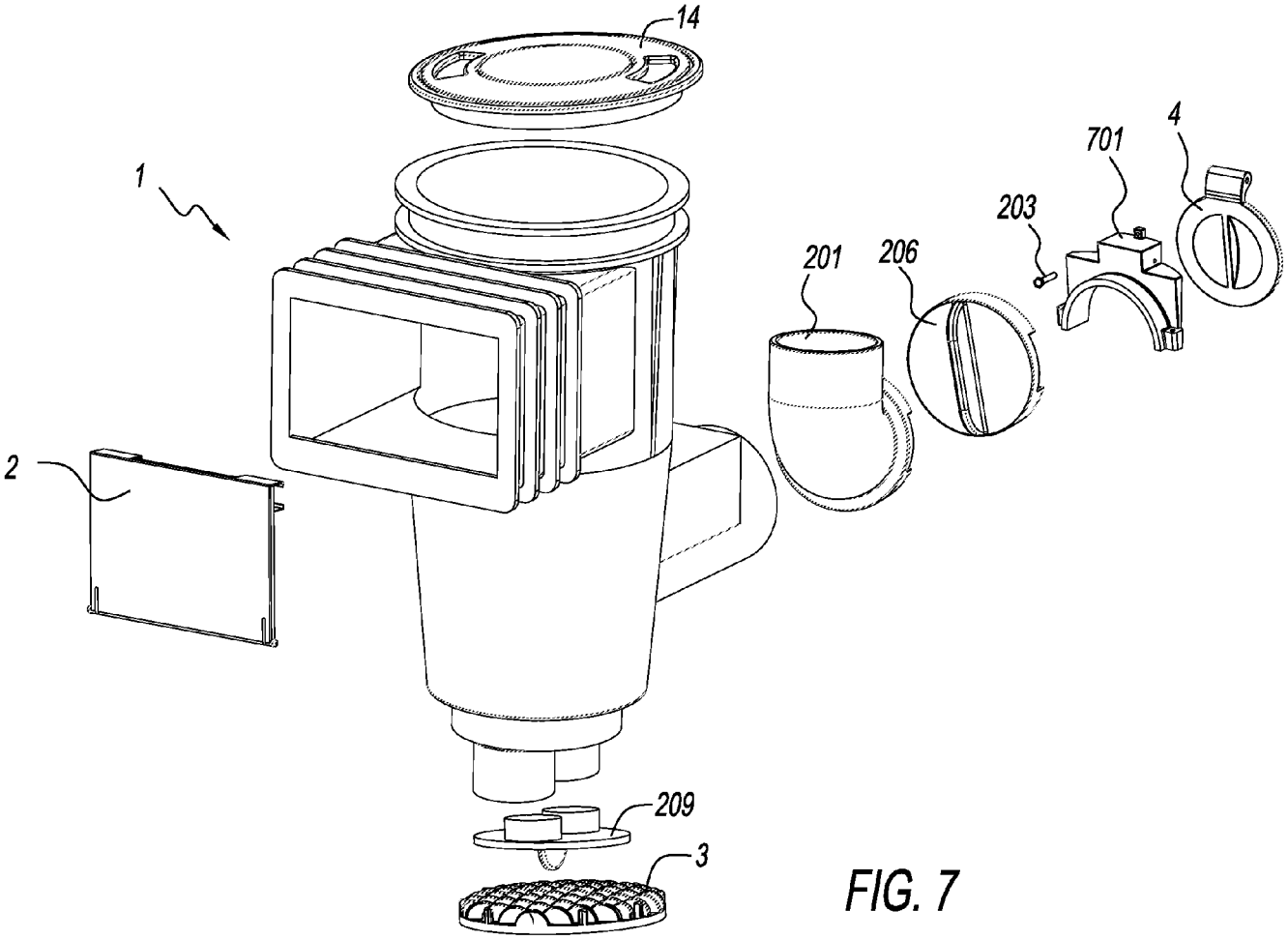
FIG. 7 is an exploded perspective view showing an arrangement of parts in a skimmer assembly.

FIG. 7 is an exploded perspective view showing an arrangement of parts in a skimmer assembly. The skimmer 1 includes skimmer lid 14, weir 2, strainer lid 3, and check valve 4. The check valve is attached to the skimmer 1 with small skimmer piece 701, which also serves as an attachment point for winterized plate 206 or vacuuming plate 201 using screw 203. Plugs 209 are inserted into inlet and outlet 406, 407 when winterized.

Figure 8:
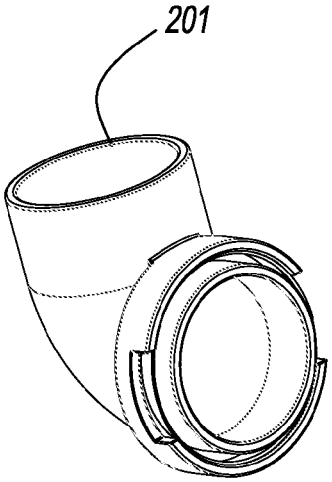
FIG. 8 is a perspective view of a vaccuuming attachment.

FIG. 8 is a perspective view of a vaccuuming attachment 201.

Figure 9:
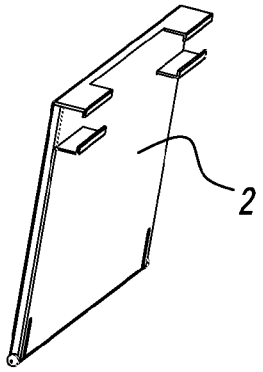
FIG. 9 is a perspective view of a skimmer weir.

FIG. 9 is a perspective view of a skimmer weir 2.

Figure 10:
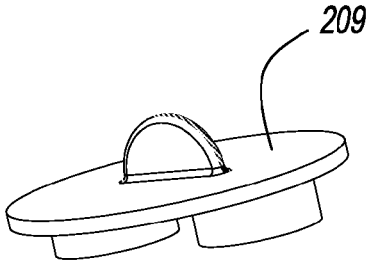
FIG. 10 is a perspective view of an inlet/outlet plug.

FIG. 10 is a perspective view of an inlet/outlet plug 209.

Figure 11:
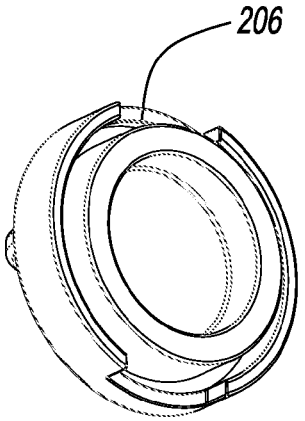
FIG. 11 is a perspective view of a winterized plate with gasket.

FIG. 11 is a perspective view of a winterized plate with gasket 206.

Figure 12:
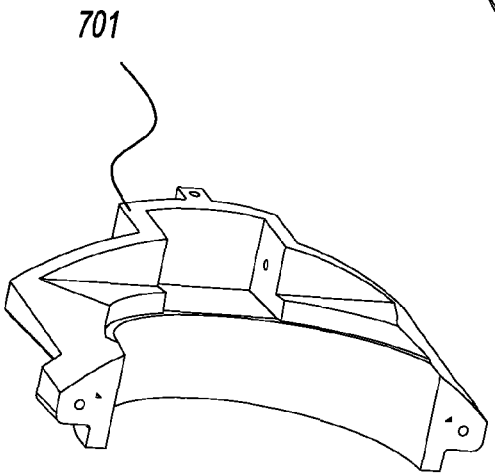
FIG. 12 is a perspective view of a small skimmer piece.

FIG. 12 is a perspective view of a small skimmer piece 701.

Figure 13:
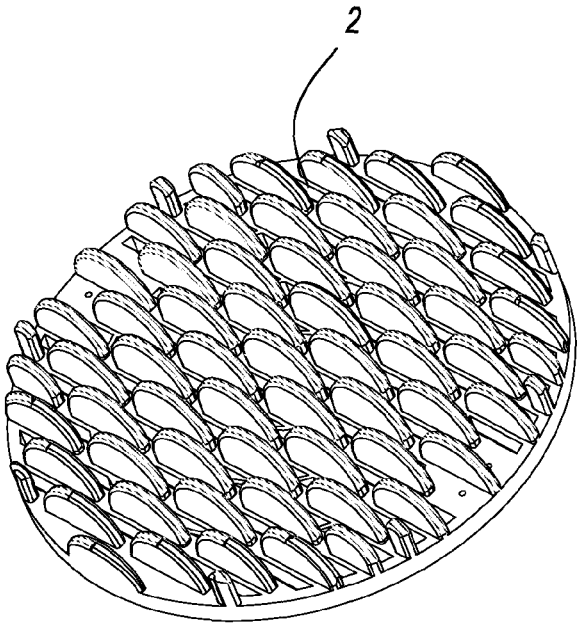
FIG. 13 is a perspective view of a removable strainer lid.

FIG. 13 is a perspective view of a removable strainer lid 3.

Figure 14:
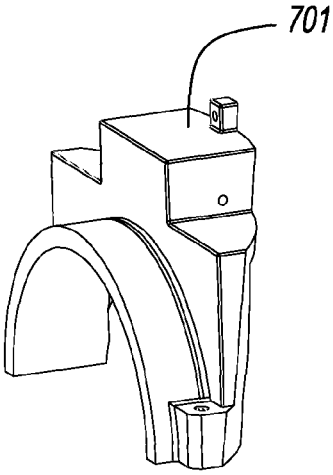
FIG. 14 is a perspective view of a small skimmer piece.

FIG. 14 is a perspective view of a small skimmer piece 701.

Figure 15:
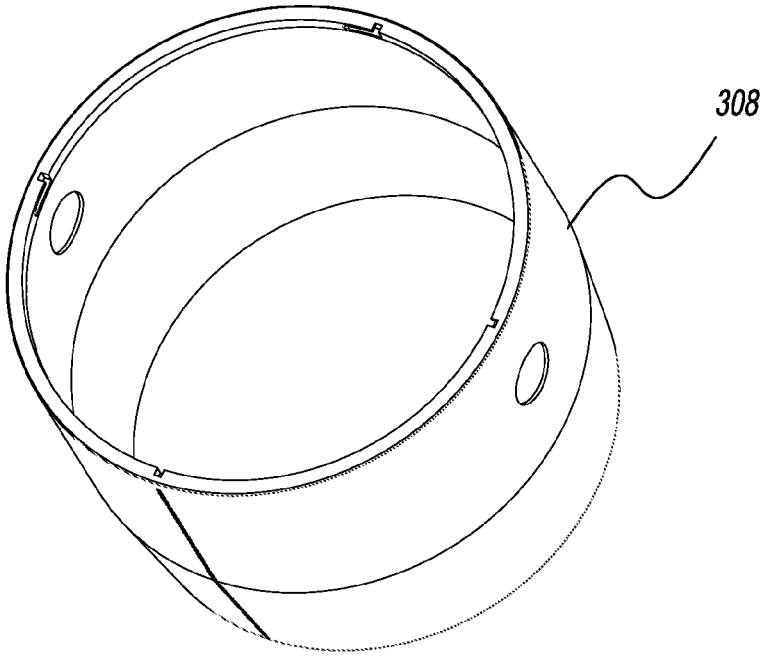
FIG. 15 is a perspective view of a debris basket.

FIG. 15 is a perspective view of a debris basket 308.

Figure 16:
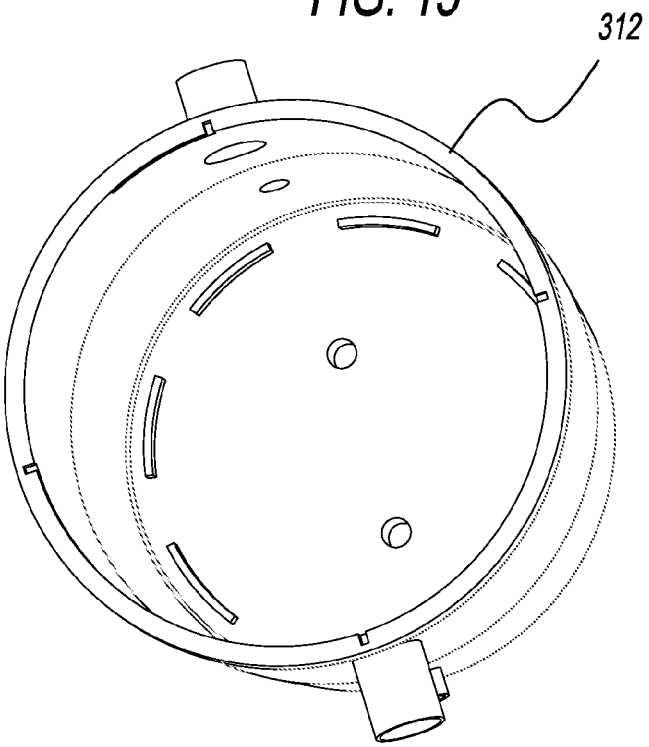
FIG. 16 is a perspective view of a debris basin.

FIG. 16 is a perspective view of a debris basin 312.

Figure 17:
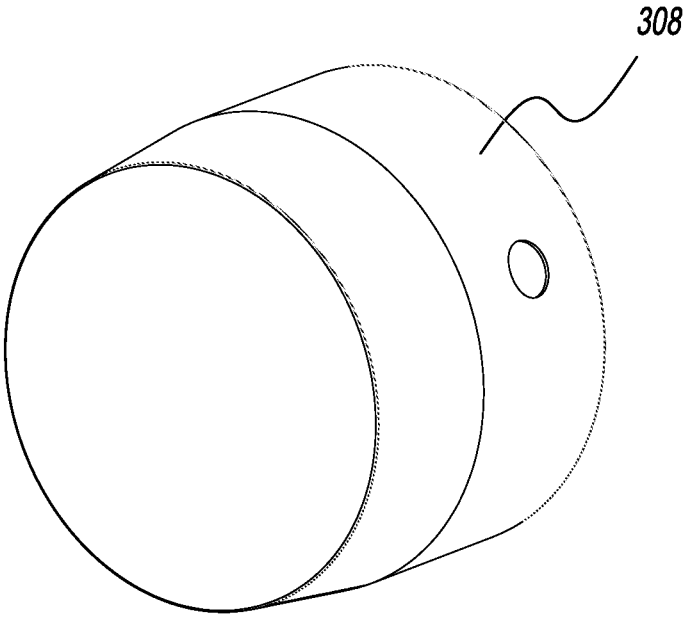
FIG. 17 is a perspective view of a debris basket.

FIG. 17 is a perspective view of a debris basket 308.

Figure 18:
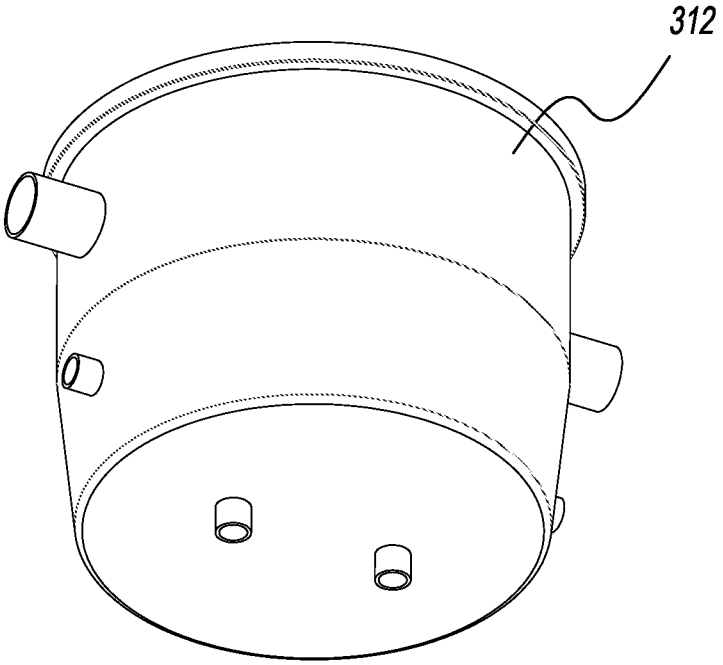
FIG. 18 is a perspective view of a debris basin.

FIG. 18 is a perspective view of a debris basin 312.

The invention is not limited to the particular embodiments described above in detail. Those skilled in the art will recognize that other arrangements could be devised, for example, using variously shaped and sized debris basins in various locations, various piping configurations, and various methods of removing the debris that accumulates in the debris basin. While the invention has been described with reference to specific illustrative embodiments, modifications and variations of the invention may be constructed without departing from the scope of the invention. The invention encompasses every possible combination of the various features of each embodiment disclosed.

We claim:

1. An swimming pool skimmer cleaning apparatus, comprising:

a debris basin comprising a debris basket; and a debris basin inlet line and a debris basin outlet line, the debris basin inlet line and the debris basin outlet line being attached to the debris basin;

wherein the debris basin inlet line connects to a swimming pool skimmer and the debris basin outlet line connects to a swimming pool plumbing system;

the swimming pool skimmer having a skimming inlet and a weir, an un-additionally filtered skimmer outlet and an un-additionally filtered fluid flow path, the un-additionally filtered fluid flow path entering the skimming inlet from the swimming pool, exiting the un-additionally filtered skimmer outlet without passing through any strainer or filtering medium between the weir and the un-additionally filtered skimmer outlet, the un-additionally filtered fluid flow path then passing into the debris basin inlet line such that a flow path from the weir to the debris basin never contains a skimmer basket or other straining or filtering medium;

wherein the debris basin inlet line is configured to deliver water from the swimming pool skimmer into the debris basket and the debris basin outlet line is configured to return water that has passed through the debris basket to the swimming pool plumbing system.

2. The swimming pool skimmer cleaning apparatus of claim 1, wherein the debris basin outlet line returns water to a three way valve having a first three way valve outlet line and a second three way valve outlet line, the first three way valve outlet line returning water to the swimming pool skimmer and the second three way valve outlet line returning water to a pool filtration system.

3. The swimming pool skimmer cleaning apparatus of claim 1, wherein the debris basin comprises two or more debris basin outlet lines attached to the debris basin at different heights, each of the two or more debris basin outlet lines returning water to the swimming pool plumbing system.

4. The swimming pool skimmer cleaning apparatus of claim 1, further comprising the swimming pool skimmer, wherein the swimming pool skimmer has no skimmer basket.

5. The swimming pool skimmer cleaning apparatus of claim 1, the swimming pool skimmer further comprising an additionally straining skimmer medium, an additionally strained skimmer outlet and an additionally filtered fluid flow path, the additionally filtered fluid flow path entering the skimming inlet, passing through the additionally straining skimmer medium, exiting the additionally strained skimmer outlet, and then passing to the swimming pool plumbing system without passing through the debris basin.

6. The swimming pool skimmer cleaning apparatus of claim 5, wherein the debris basin outlet line connects to the swimming pool skimmer below a skimmer strainer lid, the skimmer strainer lid being the additionally straining skimmer medium in the additionally filtered fluid flow path through the swimming pool skimmer.

7. The swimming pool skimmer cleaning apparatus of claim 1, further comprising a pump configured to suction water from the swimming pool skimmer and to send the water into and out of the debris basin and then to the swimming pool plumbing system, wherein the pump is connected to and suctions water from the debris basin outlet line and is connected to a pump outlet line that connects to the swimming pool skimmer by way of the swimming pool plumbing system via a first three way valve outlet line and without passing through the swimming pool.

8. The swimming pool skimmer cleaning apparatus of claim 7, wherein the pump outlet line connects to a pool filtration system via a second three way valve outlet line.

9. The swimming pool skimmer cleaning apparatus of claim 1, further comprising a check valve on the debris basin inlet line where-the debris basin inlet line connects to the swimming pool skimmer, wherein the check valve permits water to pass from the swimming pool skimmer to the debris basin inlet line only when suction is present on the debris basin inlet line and on the check valve.

10. The swimming pool skimmer cleaning apparatus of claim 9, further comprising a winterizing/vacuuming plate attached to the check valve, wherein the winterizing/vacuuming plate provides a connection for a vacuum hose attachment to the debris basin inlet line.

11. The swimming pool skimmer cleaning apparatus of claim 1, wherein the debris basin further comprises a lid, a series of clamps at the top of the basin that secure the lid to create an air tight seal, and an air bleeder valve to bleed air out.

12. The swimming pool skimmer cleaning apparatus of claim 11, wherein the debris basket further comprises one or more handles by which it can be removed from the debris basin through the lid.

13. The swimming pool skimmer cleaning apparatus of claim 11, wherein the lid is transparent.

14. The swimming pool skimmer cleaning apparatus of claim 13, wherein the debris basin comprises two or more debris basin outlet lines attached to the debris basin at different heights, each of the two or more debris basin outlet lines and a bottom portion of the debris basin are beneath a ground surface level, and the transparent lid of the debris basin is above the ground surface level.

15. A method, comprising:

attaching a vacuum to the inlet pipe of the apparatus of claim 1 where the debris basin water inlet line connects to the swimming pool skimmer in the un-additionally filtered fluid flow path, vacuuming water from the swimming pool, and sending the water vacuumed from the swimming pool through the apparatus of claim 1 via the un-additionally filtered fluid flow path.

16. The swimming pool skimmer cleaning apparatus of claim 1, further comprising a reinforcing brace that reinforces the debris basin inlet line.

17. A swimming pool skimmer cleaning apparatus, comprising:

a debris receiving enclosure comprising a filter, a debris storage area inside the filter, and an access; and a water inlet and a water outlet attached to the debris receiving enclosure;

wherein the water inlet connects to and receives water from a swimming pool skimming device via an un-additionally filtered fluid flow path and the water outlet returns water that has passed through the filter to a swimming pool plumbing system;

wherein the swimming pool skimming device has a skimming inlet, a weir and an un-additionally filtered skimmer outlet, the un-additionally filtered fluid flow path entering the skimming inlet from the swimming pool and exiting the un-additionally filtered skimmer outlet without passing through any strainer or filtering medium between the weir and the un-additionally filtered skimmer outlet, the un-additionally filtered fluid flow path then passing into the debris receiving enclosure water inlet such that a flow path from the weir to the debris receiving enclosure never contains a skimmer basket or any other straining or filtering medium between the weir and the water inlet;

wherein the water outlet is configured such that it is not blocked by accumulating debris; and wherein the access allows for removal of accumulated debris.

18. A method, comprising:

skimming water from a swimming pool at a weir of a swimming pool skimmer;

pumping water from the swimming pool skimmer to a remote debris basin such that the water passes from the weir to a remote debris basin through the swimming pool skimmer via an un-additionally filtered water flow path without the water ever passing through a skimmer basket or any other filtering or straining medium in the un-additionally filtered water flow path in any operating state or condition of the pumping;

filtering the water through a debris basket in the remote debris basin; and returning the water to a swimming pool plumbing system.

19. The method of claim 18, further comprising:

operating a swimming pool filtration system when the swimming pool is in use by swimmers;

then shutting off the swimming pool filtration system; and then performing the steps of pumping and filtering.

20. The method of claim 19, wherein returning the water to the swimming pool plumbing system comprises returning the water to the swimming pool skimmer during the steps pumping and filtering; and the step of returning the water to the swimming pool plumbing system further comprises returning the water to the-swimming pool filtration system during the step of operating.

21. The method of claim 20, wherein the step of returning the water to the swimming pool plumbing system during the steps of pumping and filtering further comprises dislodging debris from a skimmer strainer lid of the swimming pool skimmer, the skimmer strainer lid being a straining skimmer medium in an additionally filtered fluid flow path through the swimming pool skimmer.

22. The method of claim 19, wherein, the steps of pumping and filtering further comprise operating a pump in a first state wherein the water passes from a three way valve through a first three way valve outlet line and not from a second three way valve outlet line, emptying the swimming pool for winterization, and operating a source of suction operating upstream of the pump, and wherein the step of operating the swimming pool filtration system when the swimming pool is in use by swimmers further comprises operating the pump in a second state wherein the water passes from the three way valve through a second three way valve outlet line and not from the first three way valve outlet line.

* * * * *